United States Patent [19]

Day

[11] 4,146,954

[45] Apr. 3, 1979

[54] ASSEMBLY JIG FOR PREFABRICATED DOOR UNIT

[75] Inventor: Dallas C. Day, Mendota Heights, Minn.

[73] Assignee: Interior Wood Products, Inc., Saint Paul, Minn.

[21] Appl. No.: 888,952

[22] Filed: Mar. 22, 1978

[51] Int. Cl.[2] ..... B25H 1/04; B25H 1/10; B25H 7/02

[52] U.S. Cl. ..... 29/467; 267/321 F; 144/288 C

[58] Field of Search ..... 29/467, 799, 784, 281.1, 29/281.5; 144/288 R, 288 C; 108/28, 153; 269/24 CF, 321 F

[56] References Cited

U.S. PATENT DOCUMENTS

| | | | |
|---|---|---|---|
| 393,210 | 11/1888 | Chapman | 144/288 R UX |
| 2,212,421 | 8/1940 | Henderson | 144/288 C UX |
| 3,371,921 | 3/1968 | Hollomon et al. | 144/288 R |
| 3,391,464 | 7/1968 | Hutchinson et al. | 29/701 X |
| 3,406,786 | 10/1968 | Lang | 108/153 X |
| 3,807,720 | 4/1974 | Converse et al. | 269/321 F X |
| 3,866,644 | 2/1975 | Stubbs | 144/288 C |

FOREIGN PATENT DOCUMENTS

| | | | |
|---|---|---|---|
| 2458160 | 6/1976 | Fed. Rep. of Germany | 144/288 R |

*Primary Examiner*—Milton S. Mehr

*Attorney, Agent, or Firm*—Merchant, Gould, Smith, Edell, Welter & Schmidt

[57] ABSTRACT

An assembly jig for a prefabricated door unit comprises two elongated beam members which may be secured to a support surface in a parallel spaced apart orientation. A pair of holding members are detachably coupled to each of the beam members in a spaced orientation substantially equal to the width of the door unit. Each of the holding members has a recess for receiving a first pair of components of the door frame, thereby allowing the other door frame components to be nailed thereto.

14 Claims, 4 Drawing Figures

ASSEMBLY JIG FOR PREFABRICATED DOOR UNIT

BACKGROUND OF THE INVENTION

1. Field of the Invention

This invention relates in general to unassembled prefabricated door units for use in the construction industry. More particularly, this invention relates to a jig for facilitating the assembly of the door unit from its unassembled components.

2. Description of the Prior Art

The construction industry has turned increasingly to the use of prefabricated building units. Such units are used to minimize the cost of building a house or other structure by decreasing the amount of labor required by skilled craftsmen, such carpenters. More particularly, while it was once the custom for a carpenter to completely make a door frame from raw materials on hand at the job site and to the hang the door in the door frame, the high wage scale for carpenters has largely made such an operation prohibitively expensive. Thus, the use of various prefabricated door units is now widespread.

Two major types of prefabricated door units are generally in use. The first type is that which is known as a "pre-hung" door. In such a door unit, the entire door frame is assembled at the factory with the door being hung inside the frame. All that is required at the job site is for the door frame with the attached door to simply be fitted into and secured in a rough opening for the door already provided in the building.

Another type of prefabricated door unit is that which may be referred to as an unassembled door unit. One example of such a door unit is that which is known as the Boxer door unit manufactured by Interior Wood Products, Inc. of Saint Paul, Minnesota. In this type of door unit, all of the components of the door frame including any necessary moldings are pre-cut and premachined, but are not pre-assembled, at the factory. Such a door unit requires that the door frame be assembled at the job site and then placed into the rough opening in the building. Since all the components of the door unit are pre-cut, considerable labor savings are achieved since a carpenter need only assemble, but not fabricate, the door unit components.

A major disadvantage of a pre-hung door unit as opposed to an unassembled one is that the pre-hung unit is quite a bit more bulky and thus harder to hold and manipulate. The increased size of the pre-hung door unit can increase shipping costs by decreasing the number of door units which can be shipped in any given sized vehicle. In addition, because delivery men sometimes find pre-hung units hard to handle, it often occurs that such units are damaged upon delivery by dropping them while unloading. This damage causes construction delays since a new door unit must be ordered from the factory or distributor. In some cases, the delay might be quite long which often annoys the customer for whom the building is being constructed.

An unassembled door unit, such as the Boxer unit referred to previously, has a number of advantages over the pre-hung unit. First, unassembled door units can be shipped in smaller boxes since the unassembled components of the door frame and the like can be packed tighty into the box. In addition, because the shipping box is smaller, unassembled door units may be more easily handled and unloaded, thereby decreasing the chance of damaging such units. However, up until this invention, unassembled door units have customarily been sold and used without any sort of assembly jig or the like. Each user has had to find his own method of assembling the components of the door unit by hand without the aid of a jig. Such manual assembly required the user to somehow align the components of the door frame while simultaneously trying to affix them together. The difficulty associated with such an assembly operation has been a deterrent to increased utilization of unassembled door units.

While some jigs are known in the building industry for use in assembling doors and other building components, these jigs are generally only suitable for factory use. For example, most of these jigs comprise steel tables and the like which have various powered mechanisms for holding, supporting and guiding the door components being assembled. Such jigs are quite expensive and cost on the order of $300–$500. Such a large expense is not justified for the occasional unassembled door units that a small scale user, such as a small home builder or home owner, might wish to assemble.

SUMMARY OF THE INVENTION

Accordingly, one aspect of this invention is to provide a door assembly jig which facilitates the task of assembling the components of an unassembled door unit. More particularly, it is an aspect of this invention to provide such a door assembly jig which is inexpensive, lightweight, and easy to use.

The door assembly jig of this invention may be sold in either an assembled or kit form. The kit comprises two elongated beam members having a plurality of longitudinally spaced apertures therein. Each beam member has a mounting flange which allows the beam members to be attached to a support surface in a spaced apart orientation. Each beam member receives two spaced holding members in selected ones of the apertures therein. Each holding member has an upwardly facing recess which receives one of the components of the door frame (e.g., a side jamb). The holding members on the opposed beam members are aligned with one another such that the side jambs of the door frame are maintained in a spaced orientation corresponding to their orientation in the assembled door frame. With the side jambs supported in the door jig, the top plate and the sill of the door frame may be easily attached thereto. The door may then be easily hung in the assembled frame and any necessary moldings attached thereto.

BRIEF DESCRIPTION OF THE DRAWINGS

This invention will be described hereafter in the Detailed Description, when taken in conjunction with the following drawings, in which like reference numerals will denote like elements throughout.

DETAILED DESCRIPTION

Figure 1:
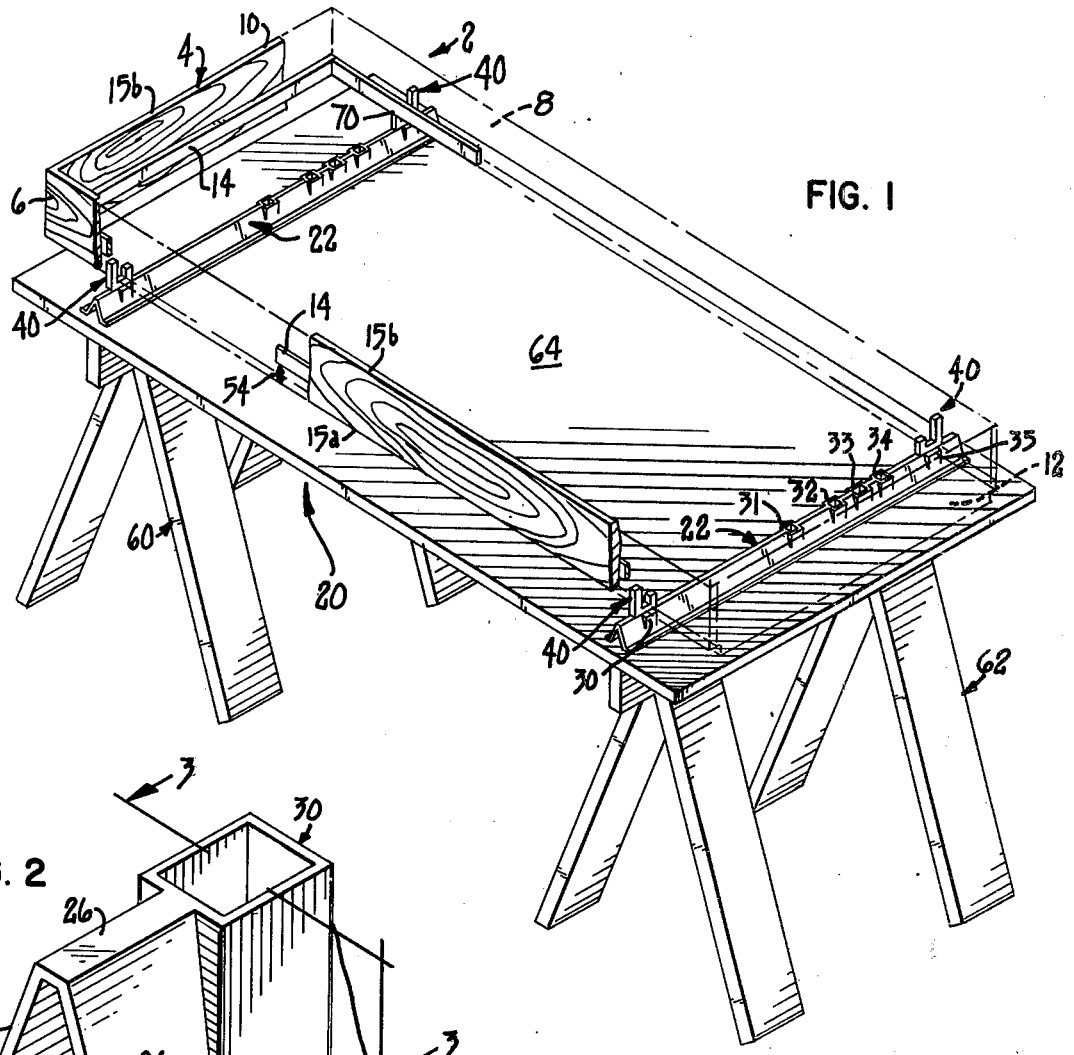
FIG. 1 is a perspective view of an assembled door assembly jig according to this invention illustrating the manner in which the jig is used to support the components of the door unit as it is being assembled.

Referring first to FIG. 1, a door assembly jig according to this invention is shown being used to assemble a pre-cut and pre-machined interior door unit generally indicated as 2. Door unit 2 comprises a door frame 4 in which a pivotable door (not shown) will be hinged or hung. Door frame 4 comprises two opposed side jambs 6 and 8 which are joined together at opposite ends by a top plate 10 and a bottom sill 12. Side jambs 6 and 8 may be said to define a first pair of opposed longitudinal door frame members while top plate 10 and bottom sill 12 define a second pair of opposed transverse door frame members. Each of the side jambs 6 and 8 and the top plate 10 are provided with generally conventional door stops 14 extending along their length at the midpoint of the width of these components. Door stops 14 will abut against one face of the door when the door is in a closed position inside door frame 4.

Door unit 2 is preferably of the type which is known and sold as the Boxer door unit and which is manufactured by Interior Wood Products, Inc., of Saint Paul, Minn. Door unit 2 has all of the components thereof pre-cut and pre-machined at the factory. These components are not assembled at the factory but are shipped from the factory to the job site in a shipping box or carton in loose unassembled kit form. Generally, the door (not shown) will be pre-hinged to one of the side jambs at the factory. In addition, door unit 2 usually includes a plurality of decorative exterior molding strips (e.g., usually six such strips which are not shown) for use in covering the end faces 15*a* and 15*b*, respectively, of both the front (i.e., the exterior) and the rear (i.e., the interior) of the side jambs 6 and 8 and the top plate 10. End faces 15*a* and *b* would otherwise be visible after door unit 2 is assembled and the rough appearance of the end faces without the moldings would detract from the appearance of door unit 2.

Figure 2:
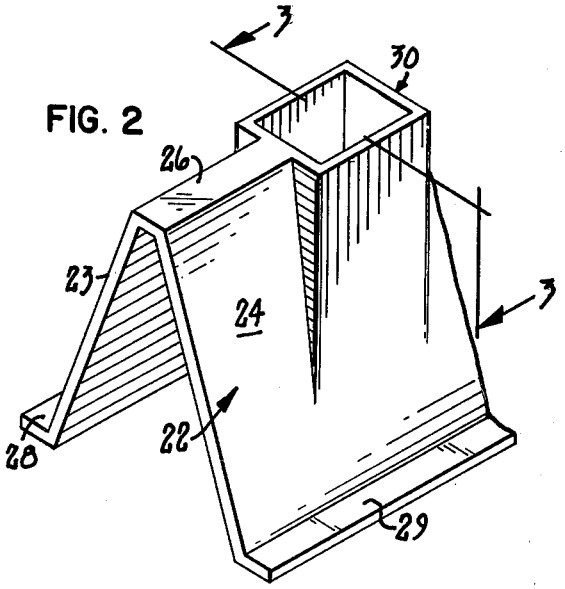
FIG. 2 is a partial perspective view of a beam member of the door assembly jig of this invention.
Figure 3:
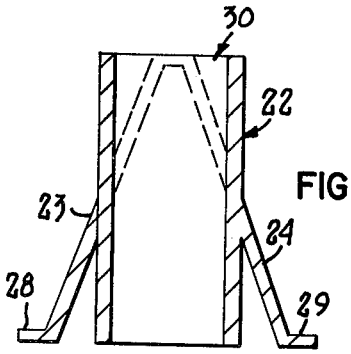
FIG. 3 is a cross-sectional view of the beam member of FIG. 2 take along the lines 3—3 in FIG. 2.
Figure 4:
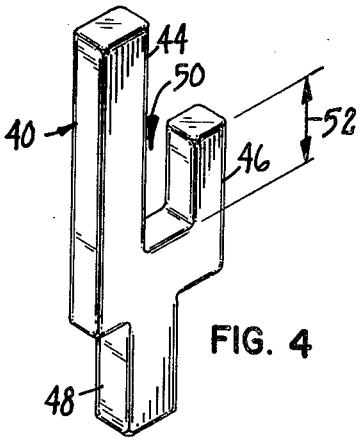
FIG. 4 is a perspective view of one detachable holding member which forms a portion of the door assembly jig shown in FIG. 1.

A door assembly jig according to this invention is illustrated generally as 20. Door assembly jig 20 comprises two longitudinally elongated beam members 22. Each beam member 22 comprises a triangular V-shaped rail having two slanted sides 23 and 24. Sides 23 and 24 are joined together at an apex 26. Two outwardly extending horizontal mounting flanges 28 and 29 are provided at the base of the sides 23 and 24. In addition, each of the beam members 22 has a plurality of apertures 30–35 spaced along the longitudinal length of the beam member. One of the apertures, i.e. aperture 30, is a reference aperture placed adjacent one end of beam member 22. The other apertures, i.e. apertures 31–35, are longitudinally spaced from the reference aperture 30 at certain predetermined distances. These predetermined distances correspond to the different widths of the various standard door sizes currently in use. As shown in FIGS. 2 and 3, each aperture 30–35 has a rectangular cross-section and vertically extends between the apex 26 and mounting flanges 28 and 29.

Door assembly jig 20 also comprises two pairs of door frame holding members 40. Each holding member 40 comprises a Y-shaped peg having two upwardly extending arms 44 and 46 and a downwardly extending projection or mounting leg 48. Leg 48 has a rectangular cross section which is adapted to be received in one of the apertures 30–35 to releasably and nonrotatably engage the holding member 40 on beam member 22. Together, the legs 48 and apertures 30–35 define an attachment means for detachably affixing the holding members 40 on the beam members 22. In addition, arms 44 and 46 are spaced apart a suitable distance to define a recess 50 which receives one of the door frame members (e.g., normally one of the side jambs 6 and 8). Recess 50 thus defines a holding means for releasably receiving and supporting some of the components of the door frame 4. Arm 46 is substantially shorter than the arm 44. The distance 52 between the top of the arm 46 and the bottom of recess 50 is substantially equal to the distance 54 between the end face 15 of a side jamb and the nearest end surface of the door stop 14.

In using door assembly jig 20 of this invention, two opposed saw horses 60 and 62 are preferably provided. Saw horses 60 and 62 are spaced apart a sufficient distance which generally corresponds to the length of door unit 2. A planar sheet 64 of plywood or some other materials forms an upwardly facing support surface for the door assembly jig 20. Sheet 64 is placed across the upper surfaces of the opposed saw horses 60 and 62. However, planar sheet 64 is not strictly necessary and may be deleted if desired. In this case, the support surface for the door assembly jig 20 will simply comprise the spaced upper surfaces of the opposed saw horses 60 and 62. In any event, beam members 22 are fixedly secured to the support surface, whether the support surface is defined by planar sheet 64 or by the upper surfaces of the saw horses 60 and 62, in a parallel orientation spaced apart a distance somewhat less than the length of the side jambs 6 and 8. FIG. 1 illustrates beam members 22 secured to planar sheet 64. However, if only the saw horses 60 and 62 are used, one beam member 22 would be secured to one saw horse and the other beam member 22 to the other saw horse. To fixedly secure the beam member 22 to the support surface, a plurality of nails or any other suitable securing means are driven through the mounting flanges 28 and 29 and into engagement with the support surface.

Once the beam members 22 are suitably secured to the support surface as shown in FIG. 1, each beam member 22 then receives two of the detachable holding members or pegs 40 as shown in FIG. 1. Pegs 40 are longitudinally spaced from one another along the length of beam member 22 a distance which generally correspond to the proposed width of the door unit 2 between side jambs 6 and 8. For example, one peg 40 is inserted into the reference aperture 30 on beam member 22 and the second peg 40 is simply inserted into that one of the remaining apertures 31–35 which corresponds to the width of door unit 2. In this regard, a suitable scale or indicia (not shown) may be placed along beam member 22 adjacent to apertures 31–35 to assist in selecting the proper aperture for receiving the second peg 40. In any event, pegs 40 are detachably inserted into beam member 22 simply by dropping the mounting leg 48 into one of the apertures 30–35. Because each aperture defines a rectangular bore which matingly receives the rectangular mounting leg 48, peg 40 is prevented from rotating in the apertures. Thus, pegs 40 are positioned on each beam member such that the longer arm 44 faces towards the outside of the beam member 22 with the shorter leg 46 facing towards the inside of beam member 22. When both pairs of pegs 40 are suitably arranged in the opposed beam members 22, the spaced pegs 40 of the first pair on one beam member 22 will be aligned with the spaced pegs 40 of the second pair on the other beam member 22, as shown in FIG. 1.

To use door assembly jig 20, side jambs 6 and 8 are inserted between the aligned pegs 40 on the spaced beam members 22. Each side jamb simply slips down into the upwardly facing recess 50 of peg 40 with the exterior surface of the side jams facing the beam members 22. The shorter leg 46 of each peg 40 will abut against the end surface of the door stop 14 as generally shown in FIG. 1 at 70. With the side jambs 6 and 8 thus supported by door jig assembly 20, it is then relatively easy for a carpenter to nail the top plate 10 and the bottom sill 12 to the ends of the jambs to form the completed door frame 4. After this has been done, the door (not shown), which has been previously removed from the hinges (not shown) provided on one of the side jambs, is reinserted into the door frame by again hanging the door on the hinges. Suitable spacers may be needed between the door and the other side jamb and these spacers may now be inserted. Door unit 2 is then turned over in assembly jig 20 and any exterior molding strips applied to the exterior end faces 15*a* of the side jambs 6 and 8 and top plate 10. After the door unit 2 has been assembled in this manner, it may be lifted up out of the assembly jig 20 and placed into and secured in the rough opening intended for door unit 2 which as been provided in the building under construction. Any interior molding strips may then be applied to cover the interior end faces 15*b* of the side jambs 6 and 8 and top plate 10. Using door assembly jig 20, door unit 2 may be removed from its shipping carton, assembled in the manner noted above, and installed in the rough opening in approximately five to ten minutes.

Both the beam members 22 and the detachable pegs 40 are preferably manufactured on injection molds from a high-impact lightweight plastic, such as standard high-impact acrylonitrile-butadiene-styrene (ABS) polymers. Such plastic material and the manufacturing process is relatively inexpensive. Consequently, door assembly jig 20 according to this invention can be produced at a low cost and sold at a low price. Thus, jig 20 can be easily afforded by a carpenter or home owner for whom the cost of prior art commercial type jigs has been prohibitive. In addition, assembly jig 20 is reusable for assembling subsequent door units 2 if so desired. The availability of door assembly jig 20 will increase the marketability and desirability of unassembled door units 2 compared to "pre-hung" door units.

It is not necessary or critical to this invention that pegs 40 be adjustable to one another along beam members 22 although this is preferred. For example, separate door assembly jigs 20 could be provided for each standard door width. In such a case, the pegs 40 on any individual jig would be integrally or fixedly attached to the separate beam members 22 at the proper predetermined width. However, such a door assembly jig 20 would be used in an identical manner to those where pegs 40 are adjustable in assembling door units 2. In addition, any suitable means of detachably attaching pegs 40 to beam members 22 can be used with the mounting leg 48 and apertures 30–35 constituting only a preferred attachment means. For example, pegs 40 could be provided with a clamp which would releasably engage the exterior surface of beam members 22. Similarly, recess 50 constitutes only a preferred holding means for receiving and supporting the side jambs 6 and 8.

The door assembly jig 20 is preferably marketed in a kit form consisting of only the beam members 22 and the four detachable pegs 40 contained in any suitable package. Upon purchasing this kit, the user can then secure the beam members 22 to two opposed saw horses 60 and 62 or to a plywood sheet 64 on top of the saw horses. Door assembly jig 20 is then used to assemble a door unit 2 as described earlier. Door assembly jig 20 could also be sold as part of an unassembled door unit 2. After using jig 20 to assemble this first door unit, jig 20 could then be reused to assemble other door units 2. If desired, door assembly jig 20 could be sold in an assembled form in which the beam members 22 are secured to a suitable support surface, such as plywood sheet 64. However, this latter marketing form is not preferred since it is more bulky than simply selling the components of door assembly jig 20 in a package in a loose unassembled form. In addition, the type of materials used to make the components of door assembly jig 20 is not critical as long as the materials actually used possess the requisite strength.

Various other modifications of door assembly jig 20 will be apparent to those skilled in the art. Therefore, the scope of this invention is to be limited only by the appended claims.

What is claimed is:

1. A door assembly jig kit having component parts capable of being assembled in the field for facilitating the assembly of a prefabricated door unit, the door unit including a first pair of opposed frame members suited to be connected together at both ends thereof by a second pair of opposed frame members to form a door frame in which a door is hung, the jig kit comprising the combination of:

a. a pair of elongated beam members, each beam member having a mounting surface for attaching the beam member to a support surface, whereby the pair of beam members may be mounted on the support surface in a parallel and spaced apart orientation; and b. two pairs of door frame holding members, each of the holding members having attachment means suited to detachably affix each pair of holding members in a spaced apart orientation on one of the beam members with the holding members on the first beam member being generally aligned with the holding members on the second beam members, each of the holding members having holding means suited to releasably receive and support one pair of opposed frame members to allow the other pair of opposed frame members to be affixed thereto to form the door frame.

2. A door assembly jig as recited in claim 1, in which the attachment means for each of the holding members comprises:

a. a plurality of substantially identical apertures spaced along the length of each beam member; and b. each of the holding members having a projection which is suited to be releasably received in any of the apertures on the beam members.

3. A door assembly jig kit as recited in claim 2, in which both the apertures and the projections have a noncircular cross-section to prevent the holding members from rotating when the projections are received in the apertures.

4. A door assembly jig kit as recited in claim 1, in which the holding means on each of the holding members comprises an upwardly facing recess suited to receive any of the frame members comprising the door frame.

5. A door assembly jig kit as recited in claim 1, in which each of the holding members comprise a Y-shaped peg, each peg having two upwardly extending arms and a downwardly extending leg, the arms being spaced apart to form an upwardly facing recess which is suited to receive any of the frame members comprising the door frame, whereby the arms define the holding means of the holding members, the leg being suited to be releasably received in any one of a plurality of spaced apertures provided on the beam members, whereby the leg and apertures define the attachment means for the beam members.

6. A door assembly jig kit as recited in claim 5, in which one of the arms on each peg is shorter than the other arm, the shorter arm being suited to abut against a door stop provided on each of the opposed frame members when the frame members are received in the recesses on each peg.

7. A door assembly jig as recited in claim 1, in which the beam member comprises a substantially V-shaped rail having at least one outwardly extending mounting flange at the bottom thereof which defines the mounting surface, the mounting flange being suited for attachment to the support surface by securing members driven therethrough.

8. A door assembly jig kit as recited in claim 1, in which both the beam members and the holding members are made of a high-impact plastic material.

9. A jig for use in assembling prefabricated door units having unassembled components comprising two side jambs, a top plate, and a door sill, which comprises:

a. a substantially horizontal support surface;

b. two elongated beam members fixed to the support surface in a parallel spaced apart orientation, and c. a pair of side jamb holding members carried on each of the beam members and being spaced apart along the beam members a distance substantially equal to a predetermined distance required between the side jambs, each of the holding members including an upwardly facing recess suitable for receiving the side jamb, the holding members on the spaced beam members being aligned with one another to respectively receive and support one of the side jambs, whereby the top plate and door sill may be affixed to the side jambs as they are supported by the holding members.

10. A jig as recited in claim 9, wherein each of the beam members have a plurality of apertures spaced along its longitudinal length at predetermined distances, and wherein the side jamb holding members comprise pegs which are detachably received in selected ones of the apertures such that the distance between the side jamb holding members can be selectively adjusted.

11. A jig as recited in claim 10, in which the detachable pegs are Y-shaped having two upwardly facing arms and a downwardly facing leg, the leg of each of the pegs being nonrotatably received in one of the apertures on the beam member, and the arms of the pegs being spaced apart a suitable distance to define the side jamb receiving recess.

12. A jig as recited in claim 9, in which the support surface is defined by the upper surface of two opposed saw horses onto which the opposed beam members are respectively attached.

13. An improved prefabricated door kit of the type having a plurality of unassembled components including a first pair of longitudinal door frame members; a second pair of transverse door frame members; and a door pivotably attached to one of the longitudinal door frame members; and wherein the improvement comprises a copackaged door assembly jig kit having component parts capable of being assembled in the field to facilitate the assembly of the door kit, the jig kit comprising the combination of:

a. a pair of elongated beam members, each beam member having a mounting surface for attaching the beam member to a support surface, whereby the pair of beam members may be mounted on the support surface in a parallel and spaced apart orientation; and b. two pairs of door frame holding members, each of the holding members having attachment means suited to detachably affix each pair of holding members in a spaced apart orientation on one of the beam members with the holding members on the first beam member being generally aligned with the holding members on the second beam member, each of the holding members having holding means suited to releasably receive and support one pair of frame members to allow the other pair of frame members to be affixed thereto to form the door frame.

14. A method of assembling prefabricated door unit kits having a plurality of unassembled components including a first pair of longitudinal door frame members; a second pair of transverse door frame members; and a door which is to be attached to one of the longitudinal door frame members; wherein the method comprises:

a. assembling a door jig on a support surface, the assembling step comprising:

i. attaching a pair of elongated beam members to the support surface in a parallel and spaced apart orientation; and ii. detachably affixing a pair of holding members to each of the beam members in a spaced apart orientation on the beam members with the holding members on the first beam member being generally aligned with the holding members on the second beam member, each of the holding members having holding means suited to releasably receive and support either pair of door frame members;

b. placing one pair of door frame members in the spaced apart holding members on the beam members such that the pair of door frame members in their spaced apart orientation correspond to the orientation which such members have in an assembled door frame;

c. fixedly attaching the other pair of door frame members to the one pair of frame members supported in the holding members to form the assembled door frame;

d. attaching the door to one of the longitudinal door frame members to form an assembled door unit; and e. removing the assembled door unit from the jig and installing the door unit in a building.

* * * * *

UNITED STATES PATENT AND TRADEMARK OFFICE

CERTIFICATE OF CORRECTION

PATENT NO. : 4,146,954

DATED : April 3, 1979

INVENTOR(S) : Dallas C. Day

It is certified that error appears in the above-identified patent and that said Letters Patent are hereby corrected as shown below:

In column 1, line 17, for "such carpenters" read --such as carpenters--.

In column 1, line 20, for "to the hang" read --to then hang--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*